US010801732B2

(12) United States Patent
Kozinski et al.

(10) Patent No.: US 10,801,732 B2
(45) Date of Patent: Oct. 13, 2020

(54) CONTROL CONSOLE ASSEMBLY FOR A COOKING APPLIANCE

(71) Applicant: Haier US Appliance Solutions, Inc., Wilmington, DE (US)

(72) Inventors: Kyle Andrew Kozinski, Louisville, KY (US); Daniel Ian Moore, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 88 days.

(21) Appl. No.: 16/284,019

(22) Filed: Feb. 25, 2019

(65) Prior Publication Data

US 2020/0271326 A1 Aug. 27, 2020

(51) Int. Cl.

| | |
|---|---|
| ***F24C 3/12*** | (2006.01) |
| ***F24C 7/08*** | (2006.01) |
| ***F24C 5/16*** | (2006.01) |
| ***F24C 15/12*** | (2006.01) |

(52) U.S. Cl.

CPC ..... *F24C 3/124* (2013.01); *F24C 3/122* (2013.01); *F24C 7/086* (2013.01); *F24C 3/126* (2013.01); *F24C 5/16* (2013.01); *F24C 15/12* (2013.01)

(58) Field of Classification Search

CPC ..... F24C 3/124; F24C 3/122; F24C 7/086; F24C 15/12; F24C 5/16; F24C 3/126

See application file for complete search history.

(56) References Cited

U.S. PATENT DOCUMENTS

| | | | | |
|---|---|---|---|---|
| 3,527,200 | A | 9/1970 | Baltz | |
| 4,074,825 | A | 2/1978 | Smith | |
| 9,513,013 | B2 * | 12/2016 | May | F24C 7/08 |
| 9,732,963 | B2 | 8/2017 | Kozinski et al. | |
| 10,605,460 | B2 * | 3/2020 | Moon | F24C 1/02 |
| 2016/0265786 | A1 | 9/2016 | Choi | |
| 2017/0215235 | A1 * | 7/2017 | Atalay | H05B 3/688 |
| 2018/0066849 | A1 * | 3/2018 | Park | F24C 7/086 |
| 2018/0274790 | A1 * | 9/2018 | Kim | F24C 3/124 |

FOREIGN PATENT DOCUMENTS

| | | | |
|---|---|---|---|
| KR | 20050005026 | A | 1/2005 |
| WO | WO2011128866 | A1 | 10/2011 |

* cited by examiner

*Primary Examiner* — David J Laux
(74) *Attorney, Agent, or Firm* — Dority & Manning, P.A.

(57) ABSTRACT

A control console for an appliance such as a cooking range and a method of assembling. The control console can include a front glass panel that is full-width so as to overlay or cover metal portions of the console as viewed from the front of the appliance. A frame may include one or more brackets having a movable paddle that can be used with an adhesive to facilitate manufacturing.

19 Claims, 15 Drawing Sheets

CONTROL CONSOLE ASSEMBLY FOR A COOKING APPLIANCE

FIELD OF THE INVENTION

The subject matter of the present disclosure relates generally to a control console for a cooking appliance such as a cooktop or range and its assembly.

BACKGROUND OF THE INVENTION

Cooktop and range appliances generally include a control panel where the user can turn on the appliance and control the amount of heat applied during the cooking process. The control panel may include other features such as a display providing e.g., information regarding the operation of the appliance, a timer, a clock, and other user controls. Aside from functional aspects, the panel also contributes to the overall appearance of the appliance.

Conventionally, the control panel is housed within a console constructed from one or more metal pieces. These pieces may be formed by bending the metal into parts that are then attached together e.g., by welding or the use of screws, rivets, or other mechanical fasteners. The metal pieces may also be created by a deep drawing process where the metal is pushed into a die by a punch. The metal that is used may include e.g., stainless steel.

The geometry of the pieces that can be created using these conventional processes is limited. Large radii are required in order to avoid perforations in the metal. Complicated manufacturing steps are required to reduce gaps for the welding process, which necessitates complicated tooling setups during manufacturing. Aesthetically, a less sleek or refined appearance for the console may result.

Other materials such as porcelain or glass may be incorporated into the appearance of such consoles. Typically, in such conventional constructions, the glass does not extend the entire width of the console but, instead, is positioned behind portions of a metal frame so as to hold the glass in place or mechanical fasteners (e.g., rivets or screws) may be used. This construction can also limit the overall aesthetic appearance of the appliance.

Accordingly, an improved assembly for a control console of a cooking appliance would be useful. More particularly, a cooking appliance having a control console that can be manufactured without the large radii or other artifacts of conventional metal forming techniques and constructions would be useful. Such a cooking appliance that includes non-metal such as glass to enhance the overall aesthetic appearance would be particularly beneficial. A method for assembly of the same would also be useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a cooking appliance having front, back, and opposing sides. The cooking appliance can include a top panel having a plurality of heating elements where each heating element is configured for use in cooking one or more food items. A plurality of heating element control units are provided with each heating element control unit configured for controlling at least one of the heating elements. A control console may be positioned adjacent to the top panel. The control console can include a pair of opposing end caps with an upper rail and a lower rail connected to the end caps and extending horizontally between the end caps.

A bracket can be connected to, and extend between, the upper rail and the lower rail. The bracket may have a plurality of bracket openings with each opening configured for receipt of one of the heating element control units. The bracket can include a main body and a movable paddle, where the main body defines an aperture into which the movable paddle is positioned. The movable paddle can be attached to the main body by a connector that allows the movable paddle to move relative to the main body so as provide a recess.

A glass panel may be secured by a first adhesive to the movable paddle and by a second adhesive to the upper rail and the lower rail. The first adhesive is received into the recess and onto the movable paddle. The glass panel can have a top edge overlaying the upper rail, a bottom edge overlaying the lower rail, and opposing side edges overlaying the end caps. The glass panel may include a plurality of glass panel openings aligned with the bracket openings and receiving a portion of the heating element control units.

In another exemplary aspect, the present invention provides a method of assembling a control console of a cooking appliance. The method can include attaching an upper rail and a lower rail to a pair of opposing end caps such that the upper rail and lower rail extend between the pair of opposing end caps; connecting a pair of brackets to the upper rail and the lower rail such that the brackets extend between the upper rail and lower rail. Each bracket can have a main body defining a movable paddle positioned at an aperture defined by the main body, the movable paddle attached to the main body by a connector, the main body also defining a plurality of bracket openings.

This exemplary method also includes applying a first adhesive to the movable paddle; applying a second adhesive to the upper rail and the lower rail; and pressing a glass panel together with the upper rail and the lower rail and into contact with the first adhesive and the second adhesive. The pressing may cause the movable paddle to move relative to the main body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 provides a perspective view of an exemplary embodiment of a cooking console of the present invention, while

DETAILED DESCRIPTION

Figure 1:
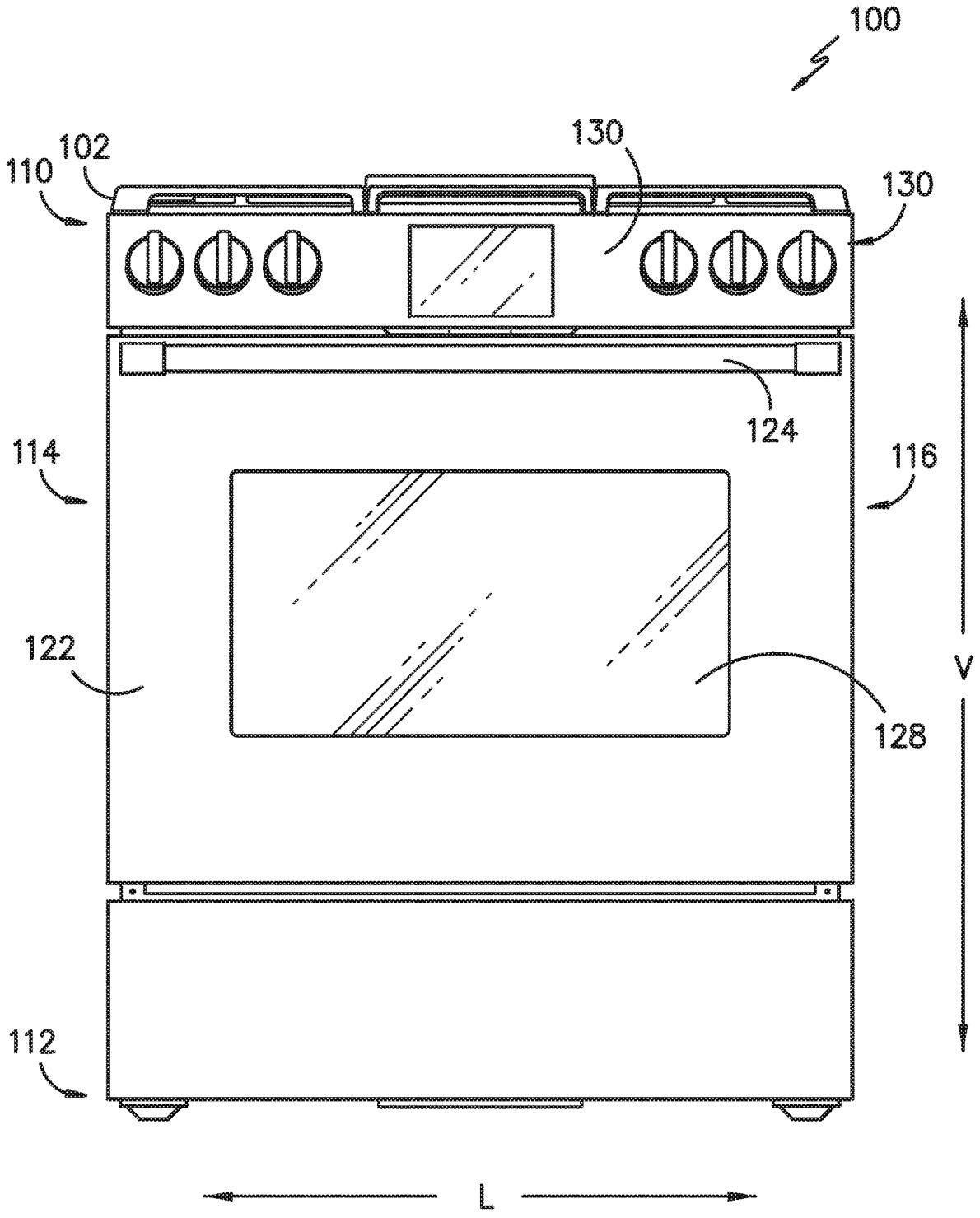
FIG. 1 provides a front view of an exemplary embodiment of a cooking appliance of the present invention.

In exemplary aspects, the present invention provides a control console for an appliance such as a cooking range and a method of assembling the same. The control console can include a front glass panel that is full-width so as to overlay or cover metal portions of the console as viewed from the front of the appliance. A frame may include one or more brackets having a movable paddle that can be used with an adhesive to facilitate manufacturing. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
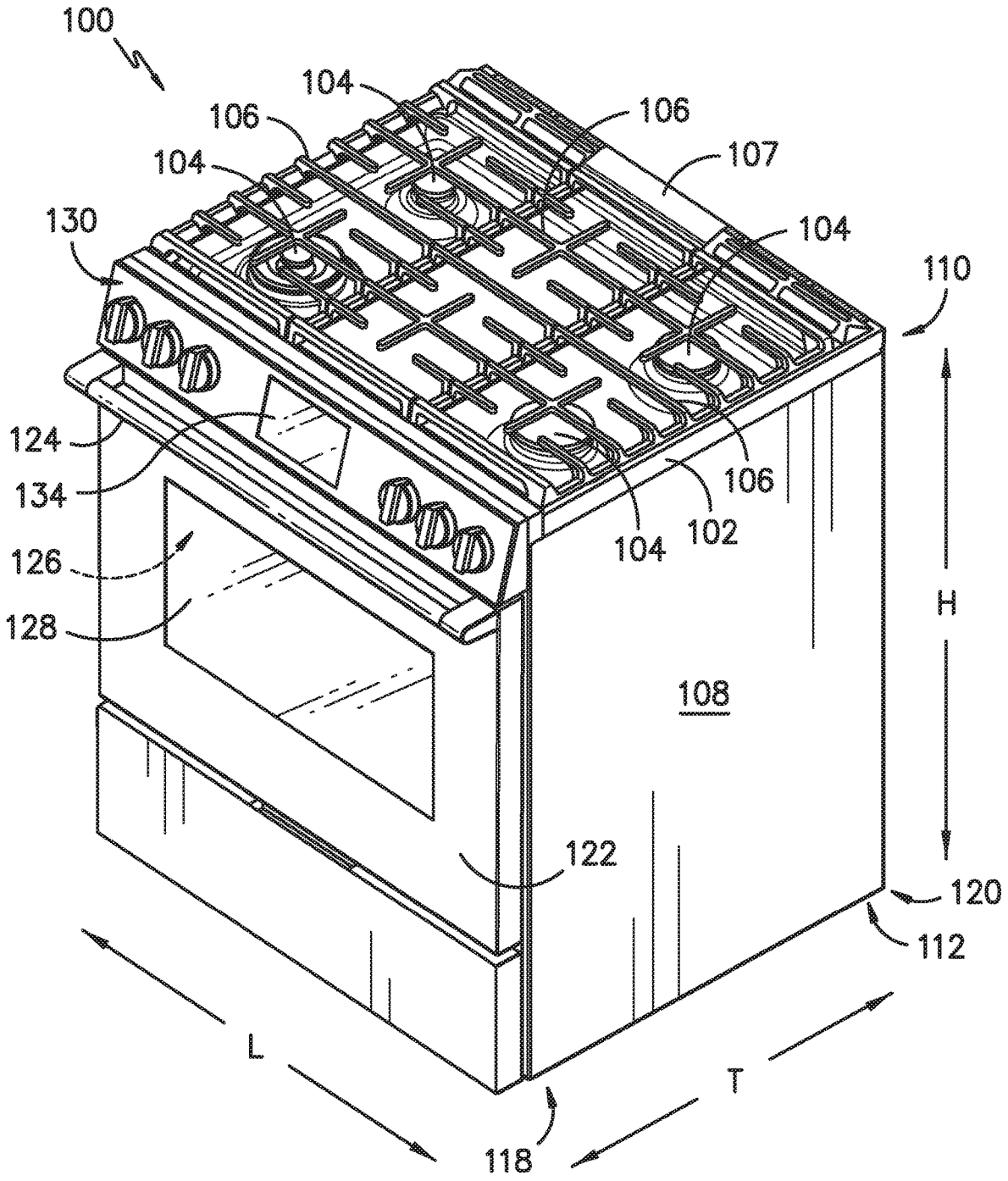
FIG. 2 provides a perspective view of the exemplary embodiment of FIG. 1.

FIGS. 1 and 2 provide views of an exemplary cooking appliance, which for this exemplary embodiment is an oven range appliance 100—it being understood that the present invention may be used with other appliances as well. As shown, appliance 100 defines a lateral direction L, vertical direction V, and transverse direction T. The vertical direction V, lateral direction L, and transverse direction T are mutually perpendicular and together form an orthogonal direction system.

Appliance 100 includes a top panel 102 having a plurality of heating elements 104, which for this exemplary embodiment are provided as gas burners of different sizes. Heating elements 104 are covered by grates 106 that can be used to support cooking utensils such as pots and pans for use in cooking one or more food items. A ventilation system 107 may also be provided to assist in removing fumes and heat during cooking operations.

Oven range appliance 100 includes an insulated cabinet 108, which extends between a top portion 110 and a bottom portion 112 along the vertical direction V. Cabinet 108 also extends between opposing sides 114 and 116 along the lateral direction L. Cabinet 108 further extends between a front 118 and a rear 120 along the transverse direction T.

A door 122 is rotatably mounted to cabinet 108 at the front 118 of the cabinet 108 e.g., with a hinge (not shown). A handle 124 is mounted to the door 122 and assists a user with opening and closing door 122 in order to access a cooking chamber 126 within cabinet 108. In some embodiments, oven range appliance 100 may include a seal (not shown) between door 122 and cabinet 108 that assists with maintaining heat and cooking fumes within cooking chamber 126 when door 122 is closed as shown in FIG. 2. Multiple parallel window panes 128 provide for viewing the contents of the cooking chamber 126 when the door is closed and assist with insulating the cooking chamber 126. Racks and other features may be provided in cooking chamber 126.

It should be understood that oven range appliance 100 is provided by way of example only and is not intended to limit the present disclosure in any particular aspect. Thus, the present disclosure may be used with other oven range appliance configurations, e.g., that define one or more interior cavities configured for receiving food, different arrangements of heating elements, and other features.

Figure 3:
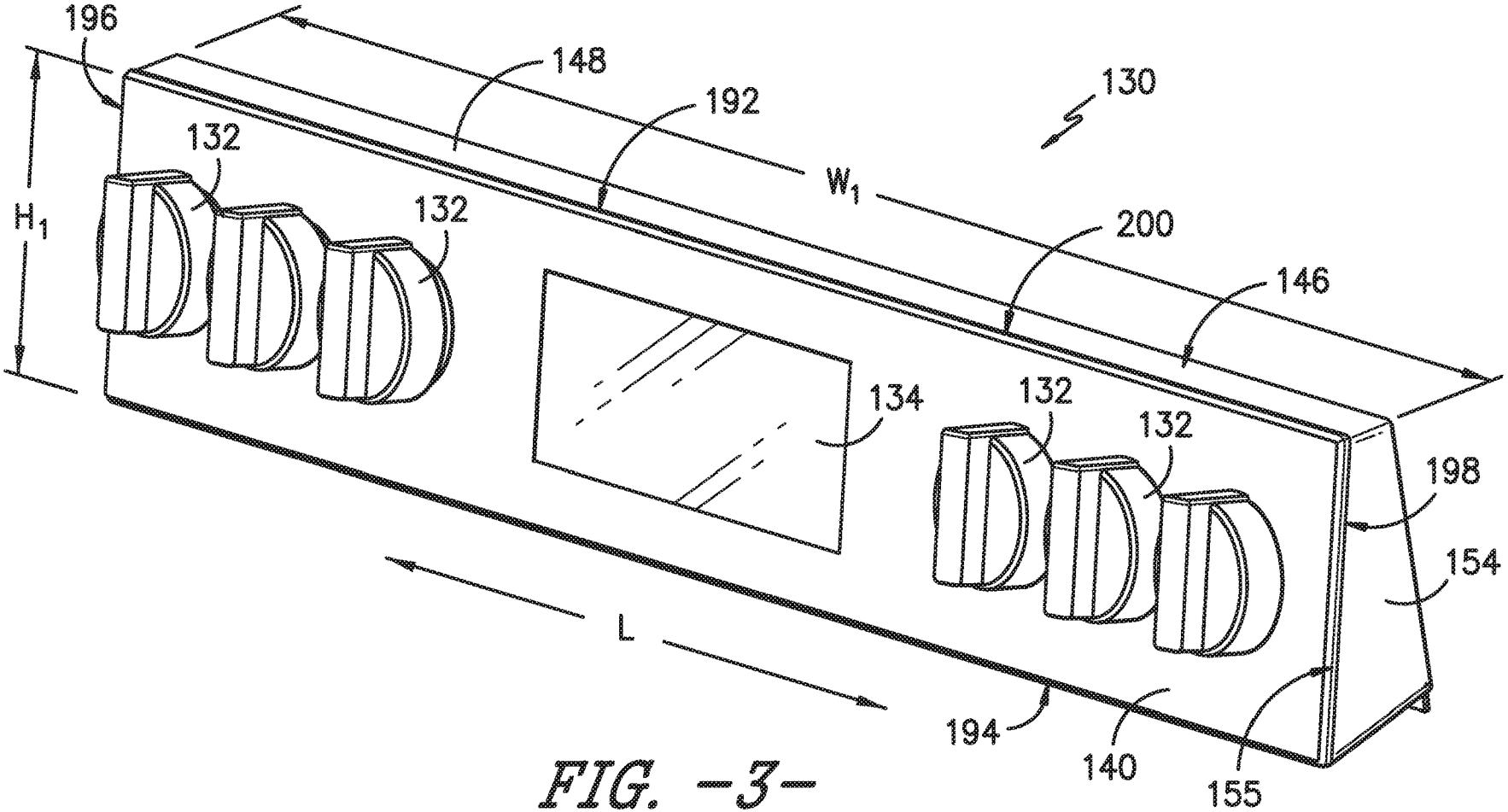
Figure 4:
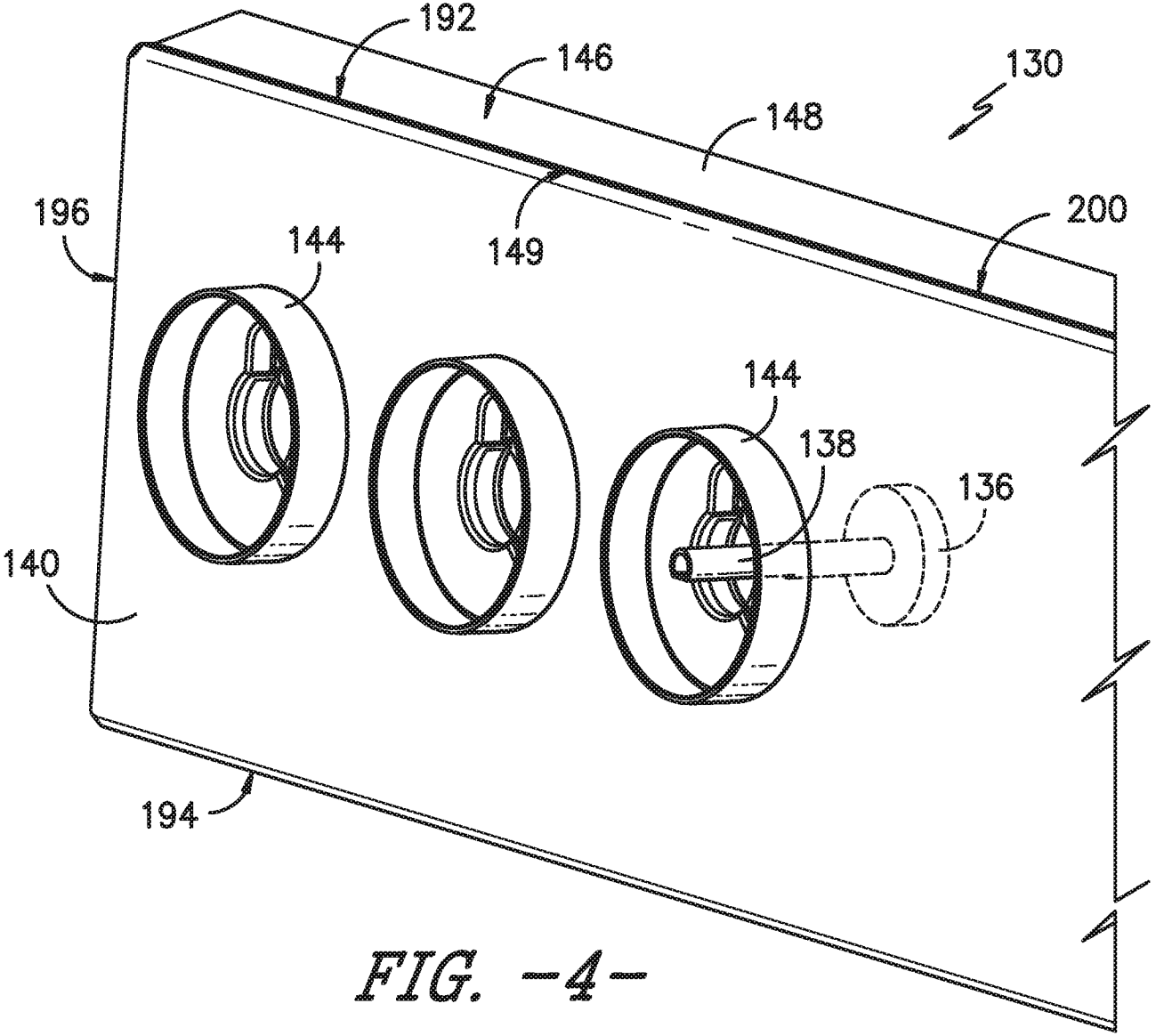
FIG. 4 is a close up view of portion of the console of FIG. 3 with control knobs removed to illustrate other features.
Figure 5:
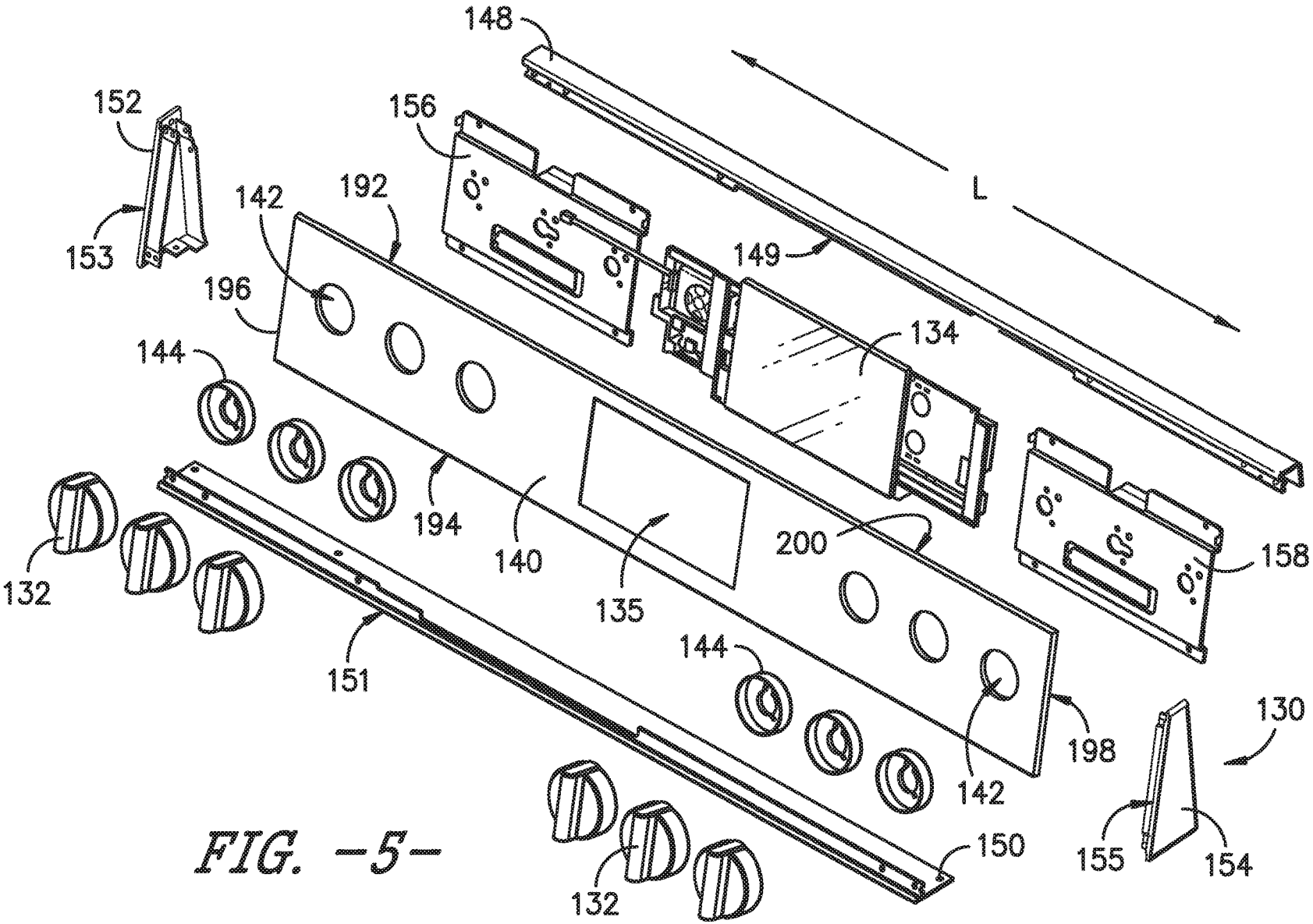
FIG. 5 is an exploded view of an exemplary control console of the present invention.

An exemplary embodiment of a control console 130 is positioned at the front 118 of range appliance 100 adjacent to top panel 102. Referring now to FIGS. 3, 4, and 5, a plurality of control knobs 132 are spaced apart on console 130 along lateral direction L. Control knobs 132, which may be rotated clockwise and counter-clockwise, allow a user to activate and adjust heating elements 104 and cooking operations in cooking chamber 126. A display 134 provides information about the operation of range appliance 100 and may include e.g., additional touch-based controls. Control knobs 132 are connected to stems 138 of a plurality of heating element control units 136 (one such example shown in FIG. 4). For example, where appliance 100 is a gas range, control units 136 may be gas valves.

Control console 130 includes a glass panel 140 having a plurality of glass panel openings 142 (FIG. 5) spaced apart along lateral direction L. A portion of the stems 138 of heating element control units 136 are received through openings 142. Control console 130 also includes a plurality of cuffs 144 (also illustrated in FIG. 15), each of which is positioned at one of the glass panel openings 142. Cuffs 144 are received into the back of control knobs 132 and provide a seamless appearance by covering glass panel openings 142. Panel 140 may include opening 135 for display 134. Glass panel 140 may be constructed from a variety of different glass materials and may be transparent, opaque, or translucent. Different colors may also be used to provide different aesthetic options. For example, the glass used for panel 140 may be a glass material to which a film or other layer has been added such as a screen on film to create a brushed metal appearance, a colored ceramic ink, and others.

As shown in FIGS. 3, 4, 5, 6, and 7, console 130 includes a frame 146 that supports glass panel 140. Frame 146 includes an upper rail 148 and a lower rail 150, which extend horizontally along lateral direction L between opposing end caps 152, 154 and are connected therewith. In one exemplary embodiment, ends caps 152, 154 are constructed from e.g., die cast aluminum and rails 148, 150 are constructed from extruded aluminum. Using such materials, smaller radii can be achieved at the corners and edges of frame 146 to improve the aesthetics of console 130.

For this exemplary embodiment, control console 130 includes a pair of brackets 156 and 158 positioned on opposing sides of graphic display 134. In other embodiments, a single bracket may be provided as a unitary piece that includes an opening for receipt of display 134. Each bracket 156, 158 is connected to, and extends between upper rail 148 and lower rail 150. For the exemplary embodiment shown, brackets 156 and 158 do not connect with opposing end caps 152 and 154.

Figure 8:
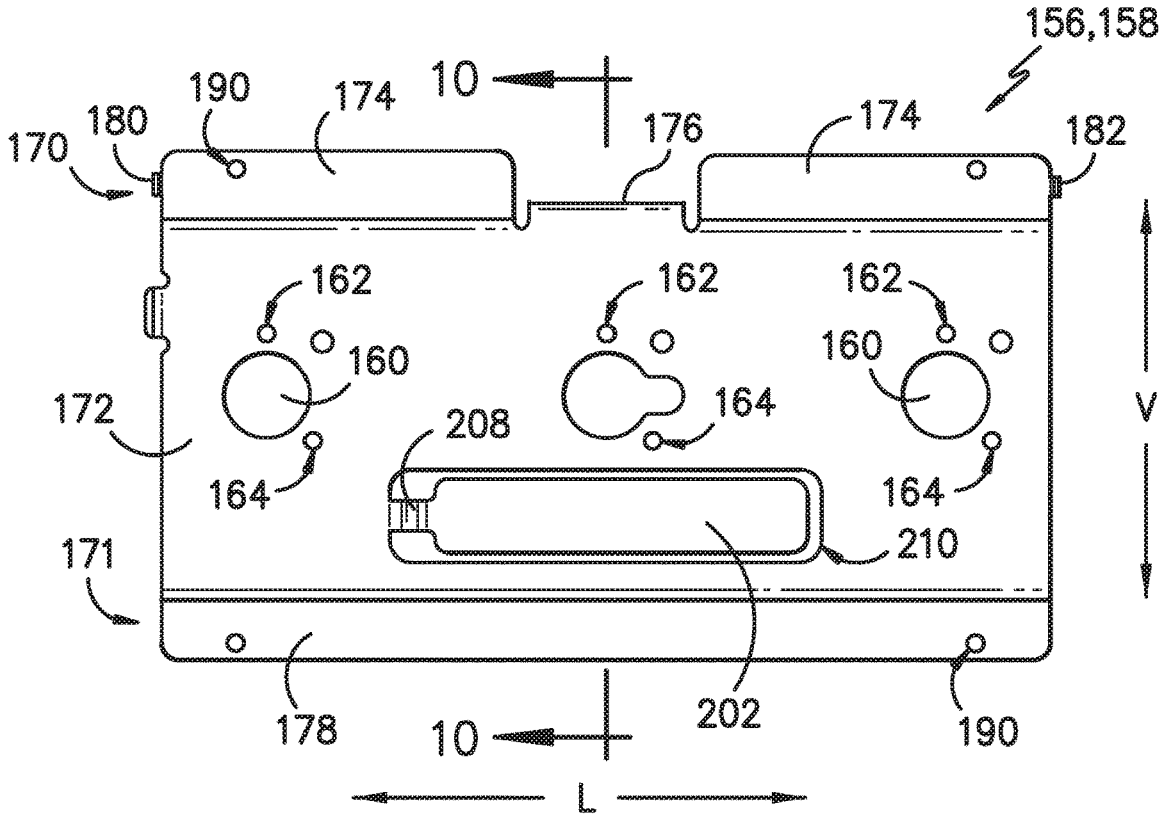
FIGS. 8, 9, and 10 are front, perspective, and side views of an exemplary bracket of the present invention.
Figure 9:
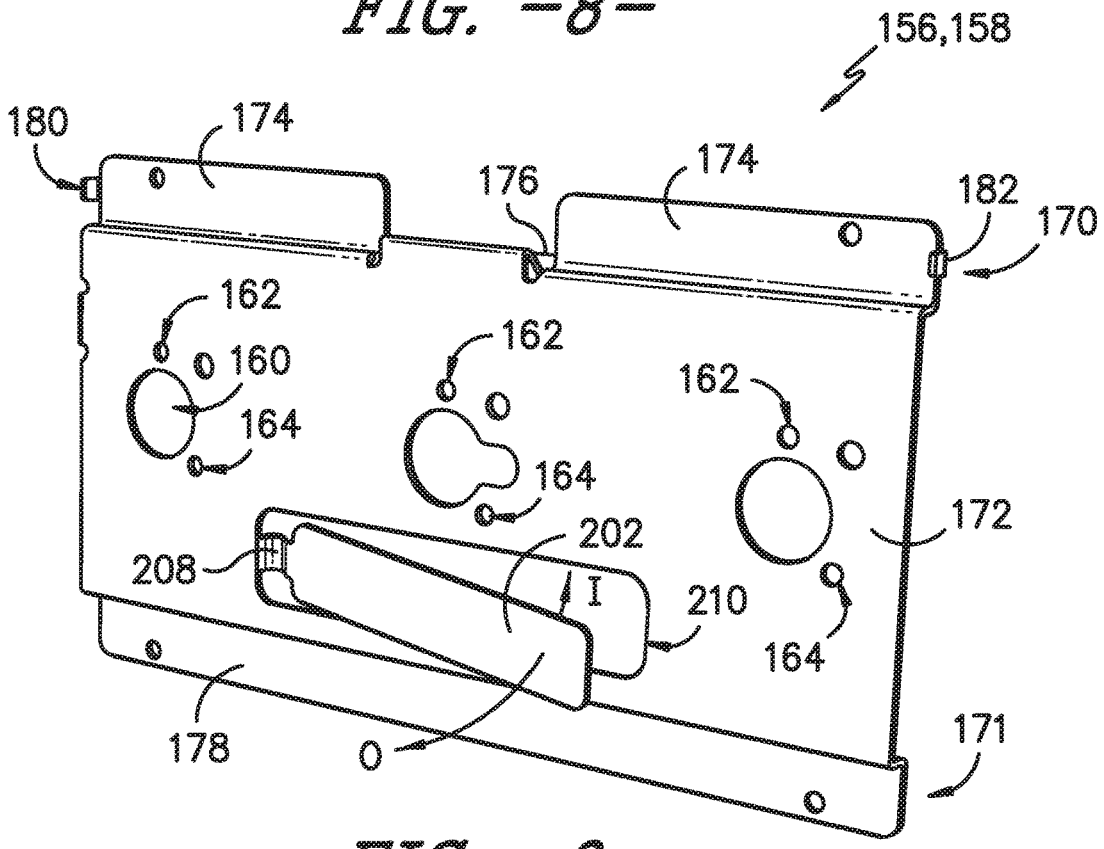
Figure 15:
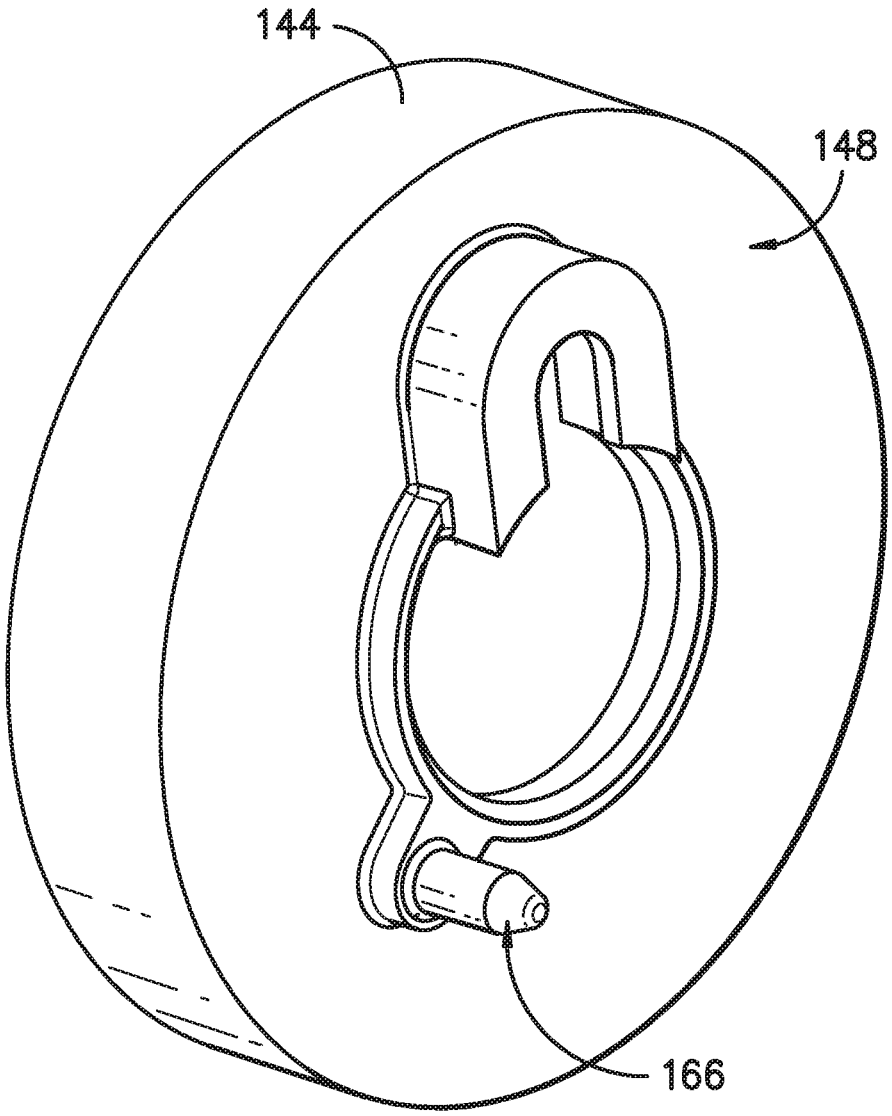
FIG. 15 is a rear view of an exemplary cuff of the present invention.
Figure 16:
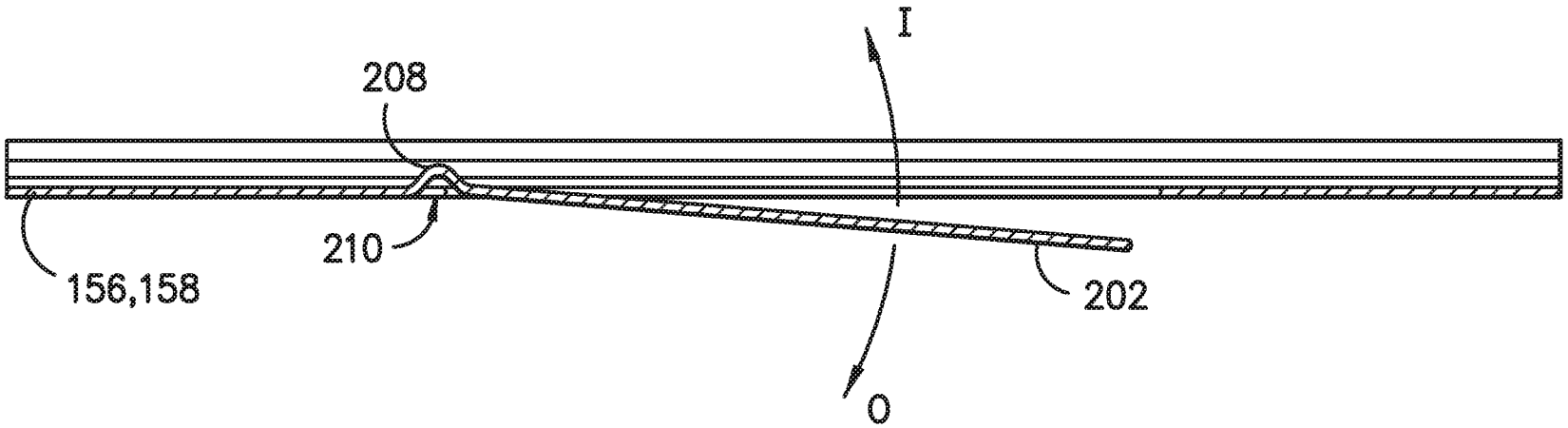
FIG. 16 is side view of a portion of the exemplary frame of FIGS. 6 and 7.

As illustrated in FIGS. 8 and 9, brackets 156, 158, each have a main body 172 that includes a plurality of bracket openings 160 that are configured for receipt of one of the heating element units 136, which in turn may each be attached to one of brackets 156, 158 using e.g., mechanical fasteners inserted through holes 162. Additionally, brackets 156, 158 include a multiple holes 164, each configured for receipt of a pin 166 protruding from the back or rear face 168 of cuff 144 as shown in FIG. 15. Pin 166 positions cuff 144 and prevents the cuff from rotating during use of a respective control knob 132.

Figure 10:
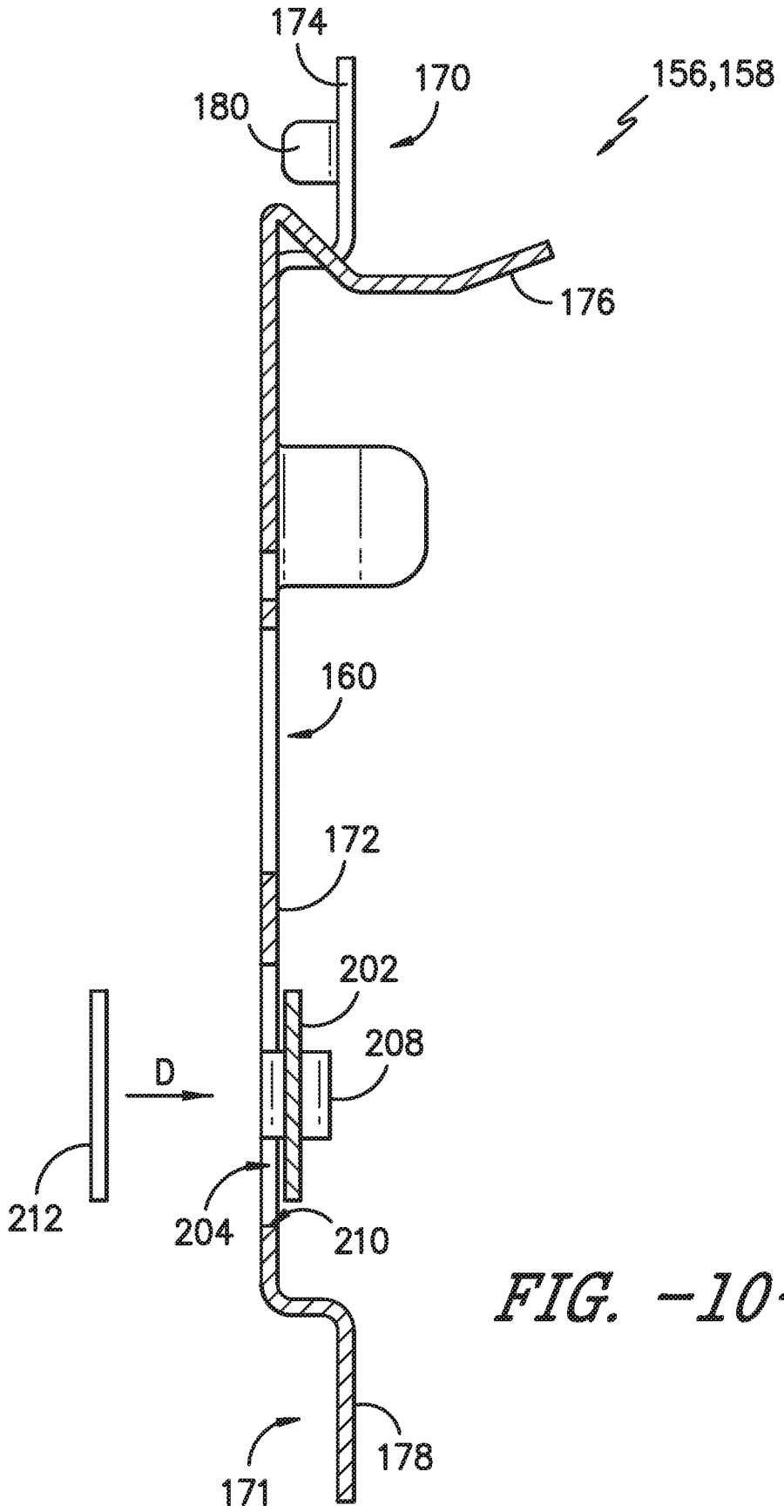

Brackets 156, 158 include several features for ensuring proper positioning within control console 130 during assembly as shown in FIGS. 8, 9, and 10. Along a top portion 170, brackets 156, 158 each include a top flange 174 and bifurcated by main body tab 176 that that is centrally located along lateral direction L. Along a bottom portion 171, brackets 156, 158 include a bottom flange 178. Each flange 174 and 178 lies in a plane that is separate, but coplanar with, main body 172. Main body tab 176 projects along a plane orthogonal to main body 172. A pair of flange tabs 180, 182 are located at the opposing ends of top flange 174. Whereas main body tab 176 projects towards rear 120 of appliance 100, flange tabs 180 and 182 project towards front 118.

Figure 11:
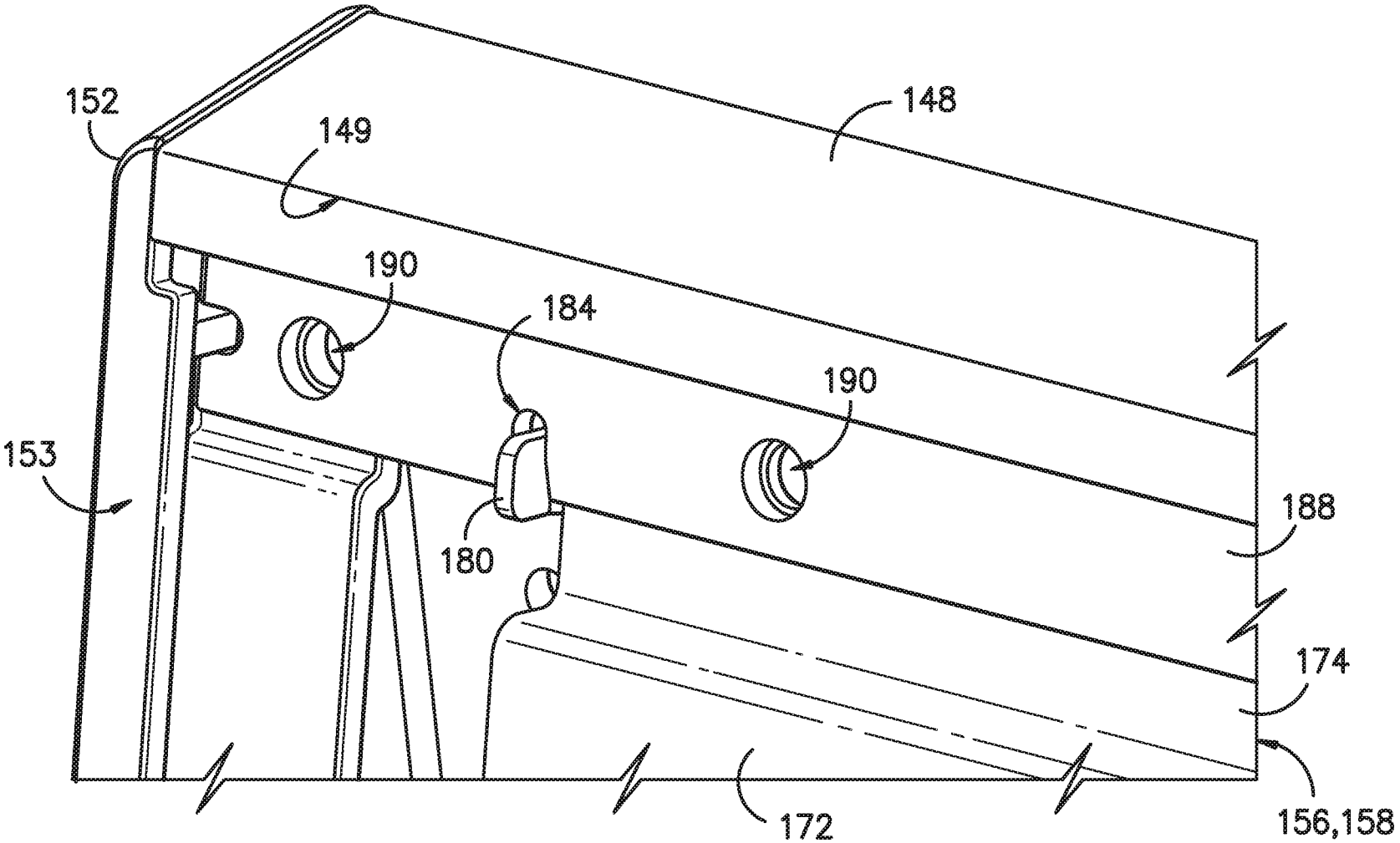
FIG. 11 is a perspective view of a portion of the exemplary frame of FIGS. 6 and 7.
Figure 12:
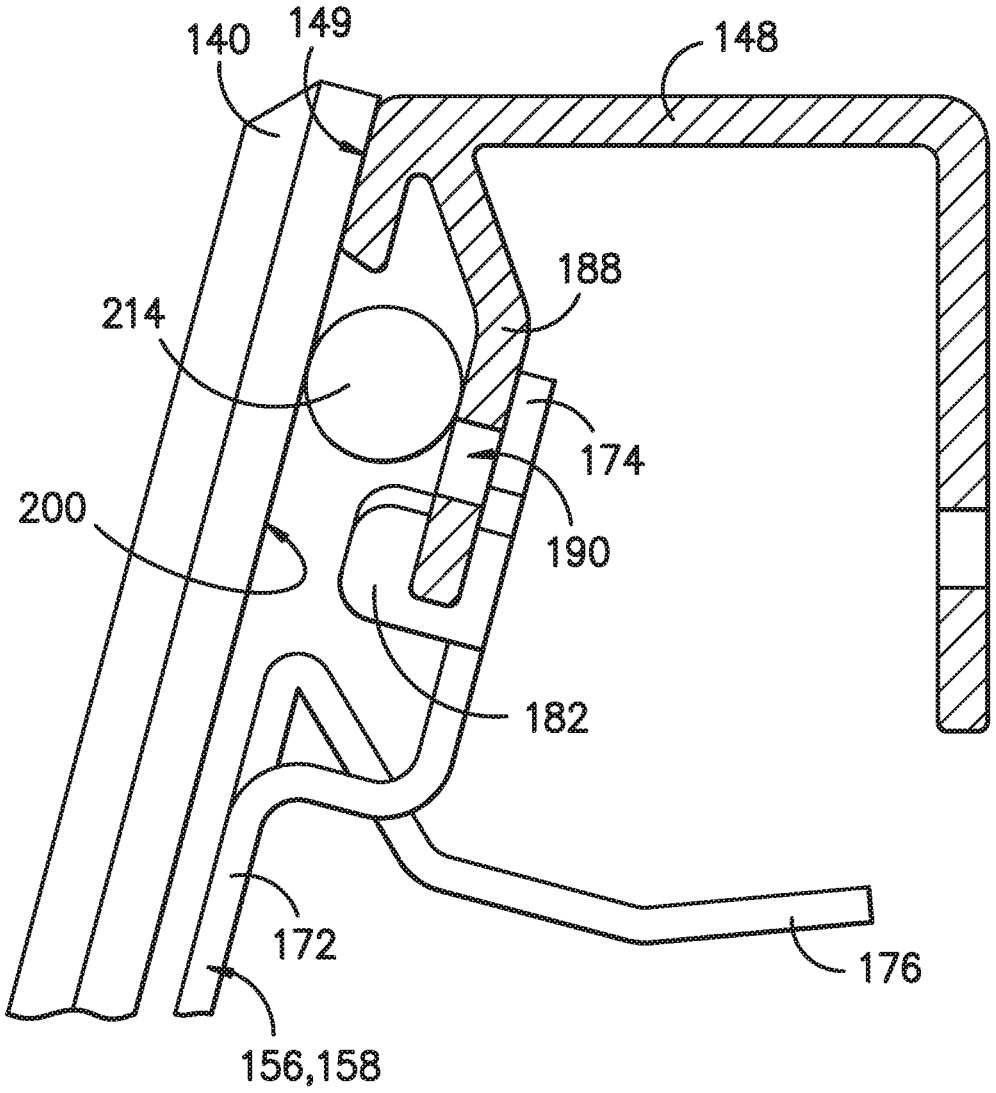
FIG. 12 is an end view of a portion of the exemplary frame of FIGS. 6 and 7 including a portion of an exemplary glass panel.
Figure 13:
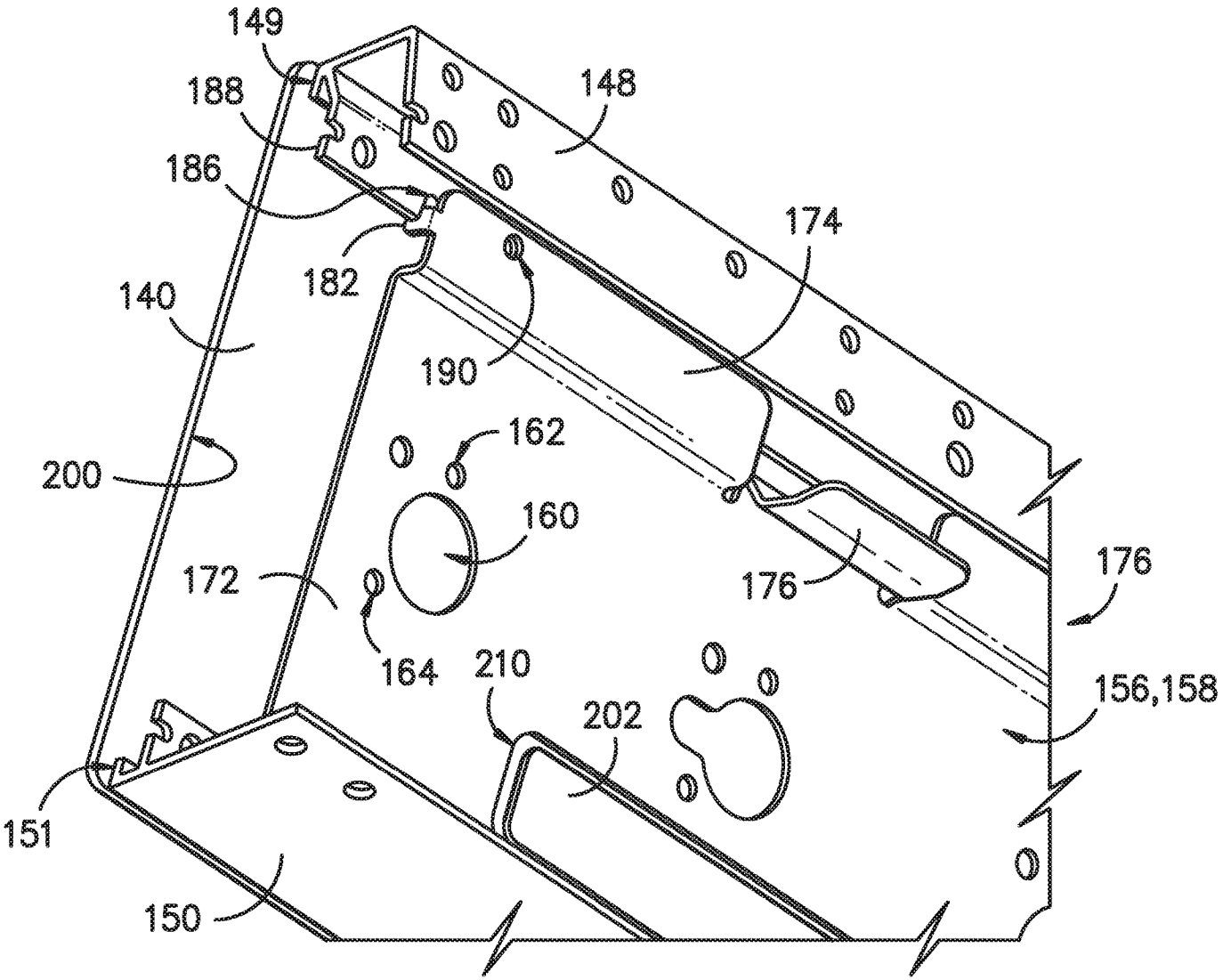
FIG. 13 is a rear view of a portion of the exemplary frame of FIGS. 6 and 7.
Figure 14:
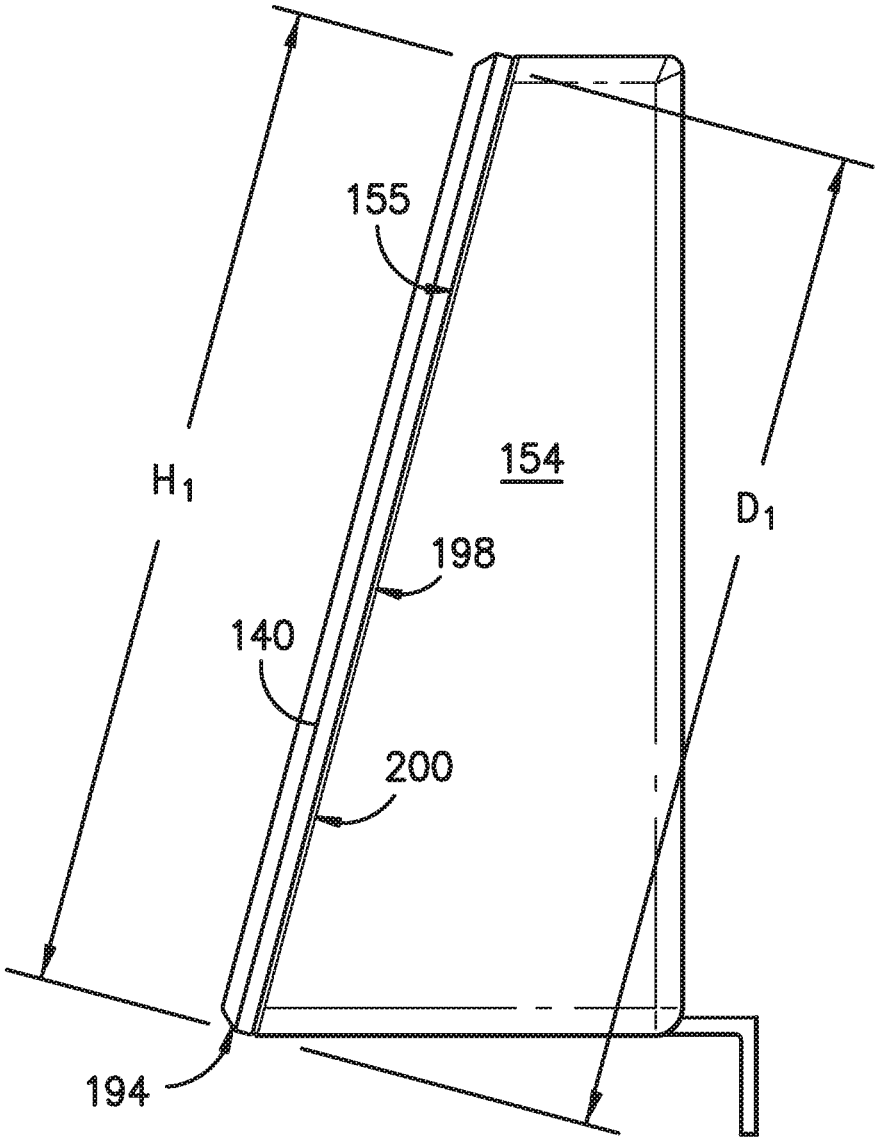
FIG. 14 is as end view of an exemplary console of the present invention.

As illustrated in FIGS. 11, 12, and 13, flange tabs 180 and 182 are received into notches 184 and 186 defined by top rail 148 while top flange 174 is simultaneously positioned behind ledge 188 of top rail 148 so as fix the position of brackets 156, 158 in top rail 148. Similar features are used to interlock bottom flange 178 with bottom rail 150 so as to secure brackets 156, 158 between rails 148 and 150. Rails 148 and 150, caps 152 and 154, and bracket 156 and 158 all include multiple openings or holes 190 for receipt of fasteners to secure these parts together when assembling console 130.

Glass panel 140 is a "full-coverage" panel for exemplary cooking appliance 100. As used herein, "full-coverage" means that glass panel 140 covers upper rail 148, lower rail 150, and opposing ends caps 152, 154 as viewed from the from the front 118 of appliance 100. Referring to FIGS. 3, 4, 12 and 14, glass panel 140 includes a top edge 192, bottom edge 194, and opposing side edges 196, 198. Edges 192 and 194 extend horizontally along lateral direction L whereas edges 196 and 196 extend between top edge 192 and bottom edge 194 at slight angle to vertical direction V when console 130 is fully assembled. Other angles, including right angles, may also be used for top and bottom edges 192, 194.

As part of an overall improved aesthetics for appliance 100, edges 192, 194, 196, and 198 fully cover the corresponding edges of frame 146. For example, end caps 152 and 154 each have a corresponding forward edge 153 and 155 (FIGS. 5, 6, 7, 11, 14) facing the front 118 of appliance 100. Similarly, upper rail 148 and lower rail 150 each have a corresponding forward edge 149 and 151 (FIGS. 5, 11, 12, and 13). As viewed from front 118 of appliance 100, when assembled, the rear surface 200 of glass panel 140 overlays and fully covers each edge 153, 155, 149, 151 to create an overall streamlined appearance for console 130 of appliance 100. As such, glass panel 140 may be referred to as "full-width" panel because as viewed from the front 118 of range appliance 100, panel 140 extends the entire height $H_1$ and width $W_1$ (FIGS. 3 and 14) of console 140 including fully covering frame 146.

During the construction of appliance 100 and specifically control console 130, proper positioning and alignment of glass panel 140 is desired to provide the full coverage described above and to properly align bracket openings 160, glass panel openings 142, and heating element control units 136. To facilitate such, brackets 156, 158 and rails 148, 150 include additional features as will now be further described.

Each bracket 156, 158 includes a movable paddle 202 as shown in FIGS. 6, 8, 9, 10, 13, and 16. Moveable paddle 202 is positioned at an aperture 210 defined by main body 172. Paddle 202 is movable back and forth along transverse direction T relative to main body 172 as depicted by arrows I (in) and O (out) in FIGS. 9 and 16. More particularly, a connector 208 attaches main body 172 and paddle 202 allowing pivoting motion of paddle 202. Connector 208 includes a u-shaped bend 210 to facilitate such movement and provide robustness.

Figure 6:
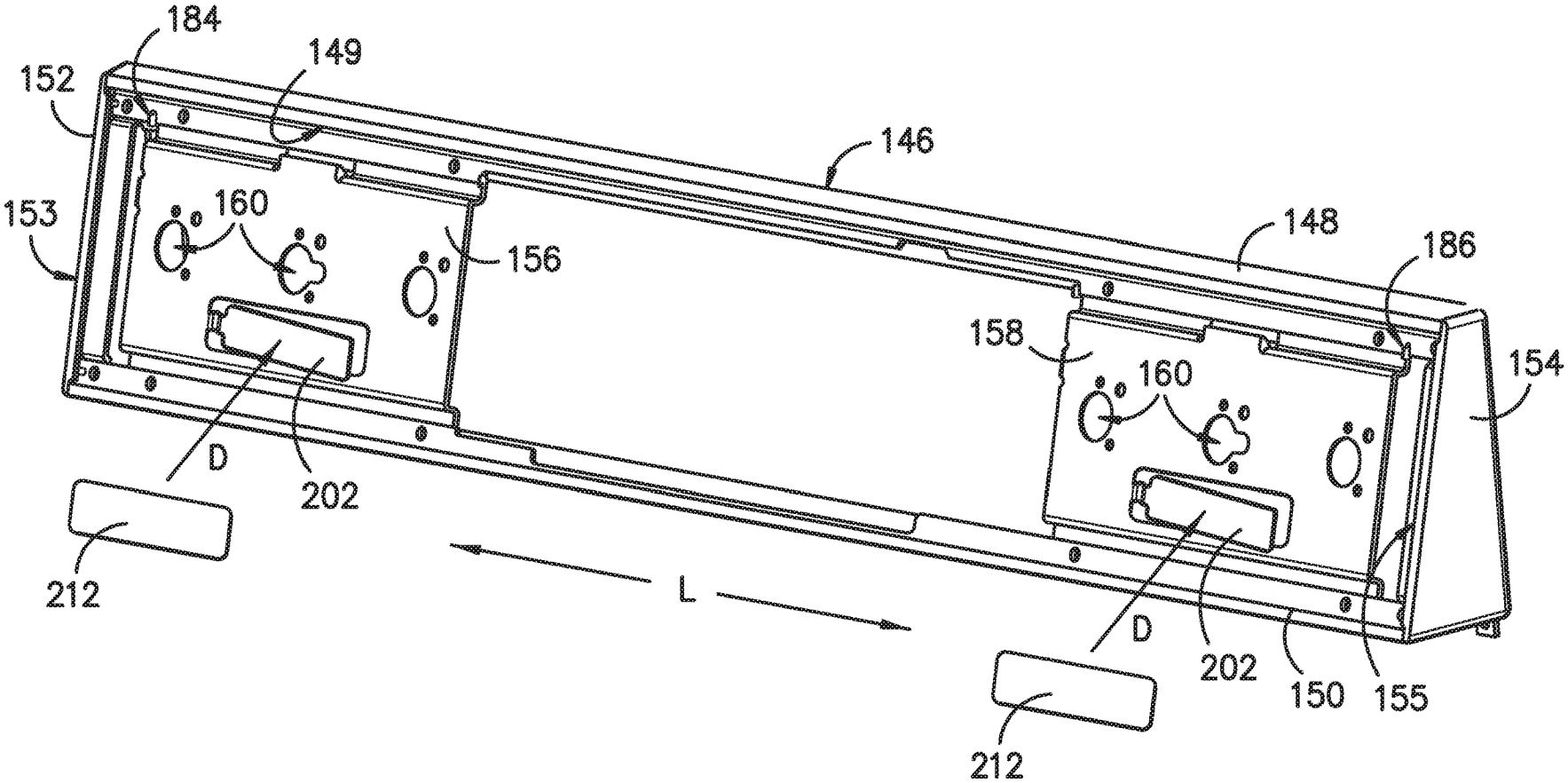
FIGS. 6 and 7 provide perspective and front views, respectfully, of an exemplary frame forming the console of FIG. 5.
Figure 7:
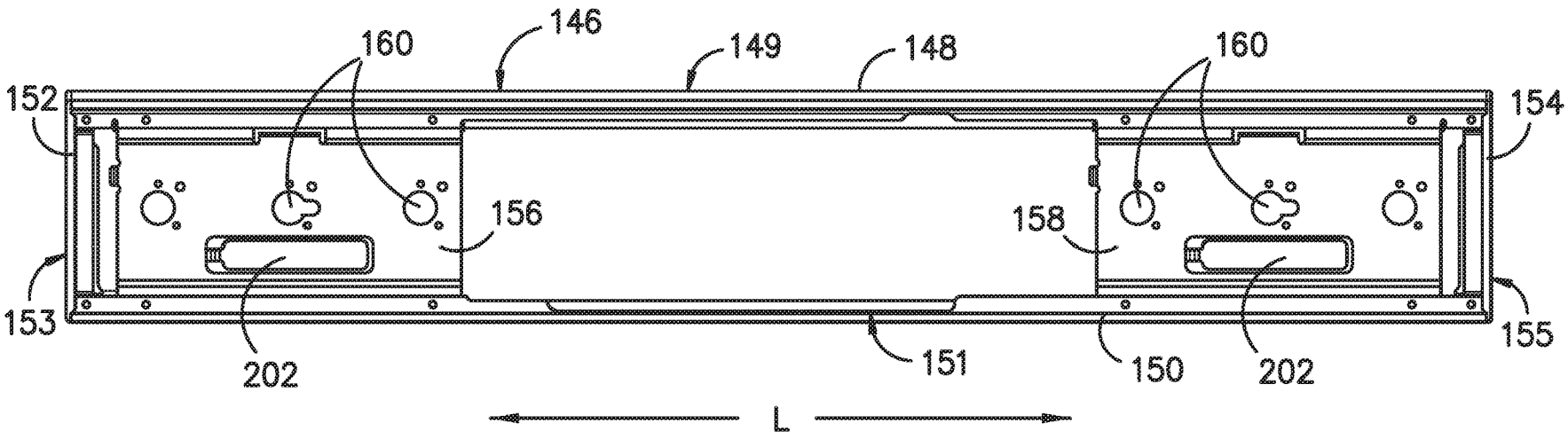

During assembly, after attachment together of the upper rail 148, lower rail 150, caps 152 and 154, and brackets 156 and 158, a first adhesive 212 is applied to paddle 202 as depicted by arrow D in FIG. 6. In one exemplary aspect, at this stage in the assembly process, paddle 202 is in a position where it is bent outwardly of main body 172 or towards front 118 of appliance 100 as shown in FIGS. 6 and 9. First adhesive 212 may, for example, a very high bond (VHB) double-sided tape having adhesive on both sides of the tape. As such, first adhesive 212 is configured to immediately adhere to paddle 202 and subsequently to brackets 156, 158 (as will be further described) without need for a curing time or delay in order for the adhesive to set and secure the assembly.

A second adhesive is applied to upper rail 148, lower rail 150, and/or opposing end caps 152 and 154. For example, as shown in FIG. 12, a second adhesive 214 is applied to ledge 188 of upper rail 148. Second adhesive 214 may be, for example, a room temperature vulcanizing adhesive or sealant that may also provide a liquid-proof seal.

Once first adhesive 212 and second adhesive 214 are applied, glass panel 140 is pressed together with upper rail 148, lower rail 150, and/or opposing end caps 152 and 154. For example, glass panel 140 may be laid onto a flat surface and pressed with frame 146 formed by upper rail 148, lower rail 150, and/or opposing end caps 152 and 154. The openings 142 in glass panel 140 are aligned with bracket openings 160 as frame 146 and panel 140 are pressed together.

Such pressing will cause paddles 202 to move relative main body 172. Specifically, each paddle 202 will move or bend inwardly (arrow I)—i.e. in a direction towards the rear of appliance 100. Because paddle 202 will resist this movement, the pressing of paddle 202 with the rear surface 200 of glass panel 140 ensures that the first adhesive 212 is held tightly against rear surface 200 of glass panel 140. As noted, first adhesive 212 may be an adhesive that acts quickly to hold glass panel 140 in a proper position and alignment while second adhesive or sealant 214 cures and/or seals. As paddle 202 is pressed into place, a slight recess 204 (FIG. 10) is created between paddle 202 and rear surface 202 of glass panel 140 for the receipt of first adhesive 212.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance having a front, back, and opposing sides, the cooking appliance comprising:

a top panel having a plurality of heating elements, each heating element configured for use in cooking one or more food items;

a plurality of heating element control units, each heating element control unit configured for controlling at least one of the heating elements;

a control console positioned adjacent to the top panel, the control console comprising:

a pair of opposing end caps:

an upper rail and a lower rail connected to the end caps and extending horizontally between the end caps;

a bracket connected to, and extending between, the upper rail and the lower rail, wherein the bracket includes a plurality of bracket openings, each opening configured for receipt of one of the heating element control units, wherein the bracket includes a main body and a movable paddle, the main body defining an aperture into which the movable paddle is positioned, the movable paddle attached to the main body by a connector the allows the movable paddle to move relative to the main body so as provide a recess; and a glass panel secured by a first adhesive to the movable paddle and by a second adhesive to the upper rail and the lower rail, the first adhesive received into the recess and onto the movable paddle, the glass panel having a top edge overlaying the upper rail, a bottom edge overlaying the lower rail, and opposing side edges overlaying the end caps, the glass panel having a plurality of glass panel openings aligned with the bracket openings and receiving a portion of the heating element control units.

2. The cooking appliance of claim 1, wherein the control console comprise a pair of the brackets.

3. The cooking appliance of claim 1, wherein the first adhesive comprises a double sided tape having adhesive on each side.

4. The cooking appliance of claim 3, wherein the second adhesive comprises glue received between the glass panel and the bracket.

5. The cooking appliance of claim 1, wherein the plurality of heating elements comprise a plurality of gas burners.

6. The cooking appliance of claim 1, wherein the upper rail and the lower rail each define a ledge for receipt of the second adhesive.

7. The cooking appliance of claim 1, wherein the bracket is interlocked with the upper rail and the lower rail.

8. The cooking appliance of claim 1, further comprising a plurality of cuffs, each cuff positioned at one of the bracket openings and through one of the glass panel openings.

9. The cooking appliance of claim 8, wherein each cuff comprises a pin that extends through the bracket.

10. The cooking appliance of claim 1, wherein the upper rail, lower rail, and end caps each comprises aluminum.

11. The cooking appliance of claim 1, wherein the upper rail and lower rail comprise an extruded aluminum and wherein the end caps comprise a die cast aluminum.

12. A method of assembling a control console of a cooking appliance, the method comprising:

attaching an upper rail and a lower rail to a pair of opposing end caps such that the upper rail and lower rail extend between the pair of opposing end caps;

connecting a pair of brackets to the upper rail and the lower rail such that the brackets extend between the upper rail and lower rail, wherein each bracket has a main body defining a movable paddle positioned at an aperture defined by the main body, the movable paddle attached to the main body by a connector, the main body also defining a plurality of bracket openings;

applying a first adhesive to the movable paddle;

applying a second adhesive to the upper rail and the lower rail; and pressing a glass panel together with the upper rail and the lower rail and into contact with the first adhesive and the second adhesive, wherein the pressing causes the movable paddle to move relative to the main body.

13. The method of assembling as in claim 10, wherein each bracket has a front side and a back side, and further comprising bending the movable paddle of each bracket away from the aperture and along the front side before the pressing.

14. The method of assembling as in claim 10, wherein the pressing causes the connector of each bracket to bend so that the movable paddle can pivot towards the main body and form a recess for receipt of the first adhesive.

15. The method of assembling as in claim 10, wherein the glass panel comprises a plurality of glass panel openings, the method further comprising aligning the plurality of glass panel openings with the plurality of bracket openings.

16. The method of assembling as in claim 15, wherein the appliance comprises a plurality of heating element control units, the method further comprising extending a portion of the heating control elements through the bracket openings and the glass panel openings.

17. The method of assembling as in claim 12, wherein the pressing creates a recess for the receipt of the first adhesive between the movable body and the glass panel.

18. The method of assembling as in claim 12, wherein the control console has a front and a back, wherein the pressing comprises positioning the glass panel so that the upper rail, the lower rail, and the pair of opposing end caps are covered by the glass panel as viewed from the front of the control console.

19. The method of assembling as in claim 12, wherein the first adhesive comprises a double-sided tape having an adhesive on both sides of the double-sided tape.

* * * * *